United States Patent [19]

Spicuzza et al.

[11] Patent Number: 5,012,789

[45] Date of Patent: May 7, 1991

[54] COLD START BY-PASS VALVE

[75] Inventors: Carol A. Spicuzza; Lawrence B. Reimer, both of Janesville, Wis.

[73] Assignee: SSI Technologies, Inc., Janesville, Wis.

[21] Appl. No.: 540,629

[22] Filed: Jun. 18, 1990

[51] Int. Cl.[5] ..... F02D 9/00

[52] U.S. Cl. ..... 123/587; 123/179 G

[58] Field of Search ..... 123/587, 585, 179 G, 123/179 A, 179 R

[56] References Cited

U.S. PATENT DOCUMENTS

| | | | |
|---|---|---|---|
| 4,311,129 | 1/1982 | Kakizaki et al. | 123/179 G |
| 4,364,348 | 12/1982 | Itoh et al. | 123/179 G |
| 4,519,367 | 5/1985 | Nomura | 123/179 G |
| 4,716,871 | 1/1988 | Sakamoto et al. | 123/587 |
| 4,886,035 | 12/1989 | Tomobe et al. | 123/179 G |

FOREIGN PATENT DOCUMENTS

| | | | |
|---|---|---|---|
| 1046947 | 12/1958 | Fed. Rep. of Germany | 123/598 |

*Primary Examiner*—Andrew M. Dolinar
*Assistant Examiner*—M. Macy
*Attorney, Agent, or Firm*—Andrus, Sceales, Starke & Sawall

[57] ABSTRACT

A cold start air control device for an internal combustion engine of the type having an air delivery system in which the delivery of air to a vacuum generating manifold is controlled by a throttle valve and a by-pass valve and parallel with the throttle valve includes a casing that defines a passageway in parallel with the throttle valve and the by-pass valve and which has a cross-sectional area greater than that of the by-pass valve so as to offer a less restricted air flow path than that offered by the by-pass valve. The passageway provides communication between the manifold and atmosphere and a valve is disposed within the passageway for opening and closing the passageway in response to the vacuum level generated by the manifold.

10 Claims, 2 Drawing Sheets

FIG. 1
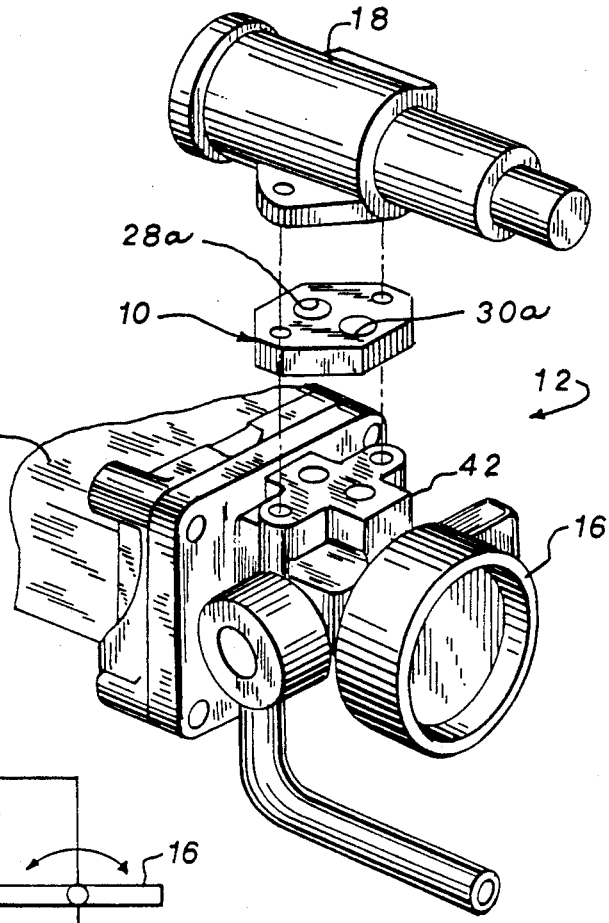
FIG. 2
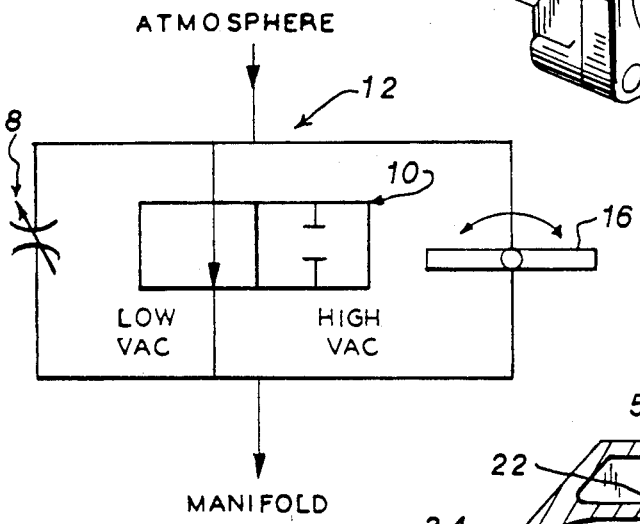
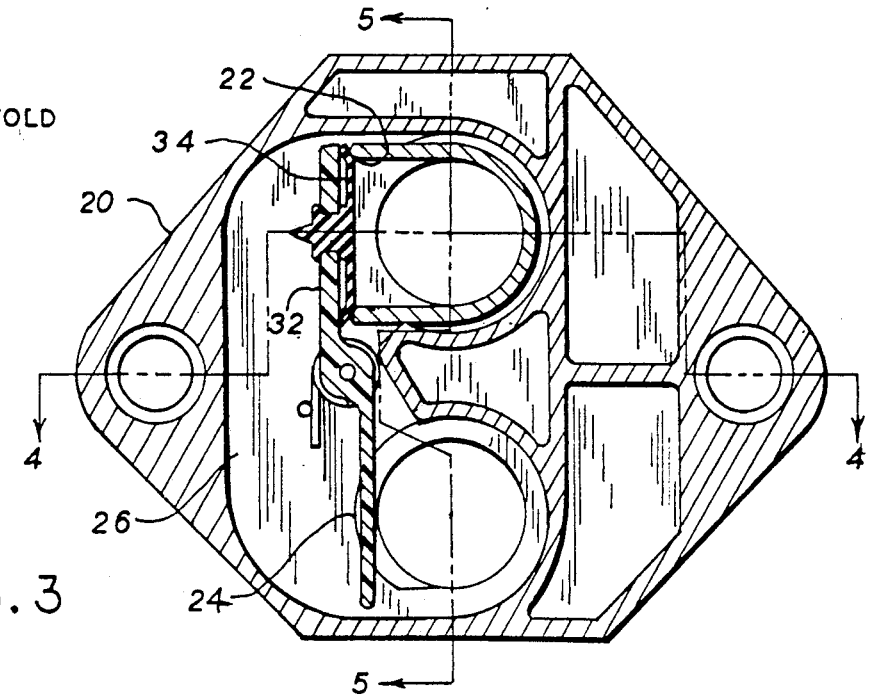
FIG. 3

COLD START BY-PASS VALVE

BACKGROUND OF THE INVENTION

The present invention relates to a cold start air control device for an internal combustion engine and more particularly to a device to be used in an air delivery system in which the delivery of air to a vacuum generating manifold is controlled by a throttle valve and a by-pass valve in parallel with the throttle valve.

A number of U.S. patents have dealt with the control of air flow to an engine during the cold start of the engine. More specifically, U.S. Pat. No. 4,102,315 regulates the air flow through the use of thermo expansive and electro expansive materials. U.S. Pat. No. 4,158,352 utilizes a different approach in which a hole is provided in the throttle valve.

Devices such as these are expensive to manufacture and/or require modification of the throttle valve.

It is an object of the present invention to provide a cold start air control device having a minimum of moving parts and capable of being used without any modification to the throttle valve.

Since it has become customary to utilize idle air by-pass solenoids in conjunction with throttle valves on internal combustion engines, it is a further object of this invention to provide a cold start air control device that may be utilized in conjunction with the throttle valve and the idle air by-pass. More specifically, it is an object of this invention to provide a cold start air control device that will bypass both the throttle valve and the idle air by-pass solenoid.

SUMMARY OF THE INVENTION

A cold start air control device for an internal combustion engine having an air delivery system in which the delivery of air to a vacuum generating manifold is controlled by a throttle valve and a by-pass valve in parallel with the throttle valve includes a casing disposed on the throttle body and having a first port communicating with the manifold and a second port communicating with atmosphere.

In accordance with one aspect of the invention, a passageway connects the first and second ports. The passageway is in parallel with the throttle valve and the by-pass valve and has a cross-sectional area greater than that of the by-pass valve so as to offer a less restricted air flow path than that offered by the by-pass valve.

In accordance with yet another aspect of the invention, a valve is disposed within the passageway for opening and closing the passageway and the valve is biased to an open position and movable to its closed position in response to a vacuum level generated by the manifold.

In accordance with still another aspect of the invention, the first port includes a pair of openings in the casing with one of the openings communicating with the manifold side of the by-pass valve and the other of the openings communicating with the manifold side of the throttle valve.

In accordance with still another aspect of the invention, the second port includes a pair of openings in the casing with one of the openings communicating with the atmosphere side of the by-pass valve and the other of the openings communicating with the atmosphere side of the throttle valve.

The present invention thus provides an inexpensive and easily manufactured cold start air control device that may be utilized in conjunction with a throttle valve and its associated by-pass valve.

BRIEF DESCRIPTION OF THE DRAWINGS

The drawings illustrate the best mode presently contemplated of carrying out the invention.

In the drawings:

FIG. 1 is an exploded perspective view of a manifold, throttle valve, and by-pass valve utilizing the cold start device of the present invention;

FIG. 2 is a schematic of the air delivery system of FIG. 1;

FIG. 3 is a top cross-sectional view of an air control device constructed according to the present invention with the valve in a closed position;

DETAILED DESCRIPTION OF THE PREFERRED EMBODIMENT

Figure 4:
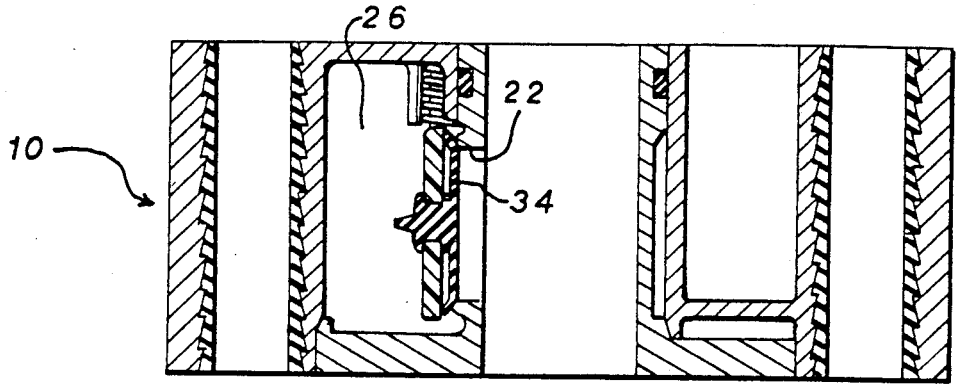
FIG. 4 is a sectional view along the line 4—4 of FIG. 3.
Figure 5:
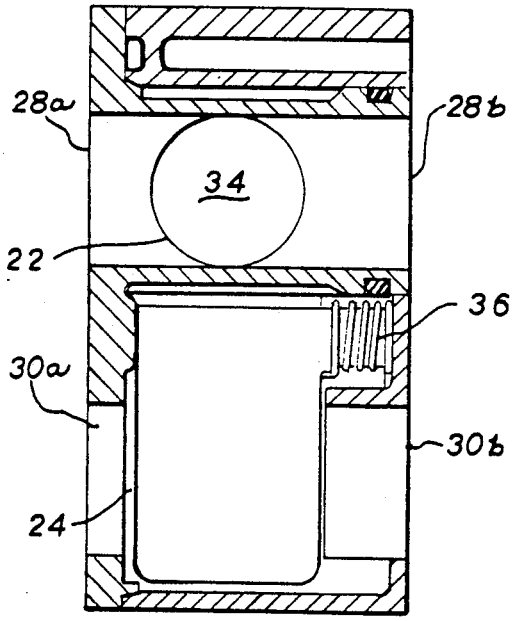
FIG. 5 is a sectional view along the line 5—5 of FIG. 3.

FIG. 1 illustrates the use of a cold start air control device 10 in conjunction with the air delivery system 12 for an internal combustion engine (not shown). Air delivery system 12 includes a vacuum generating manifold 14 which is supplied with air via throttle valve 16 and solenoid operated by-pass valve 18 that typically controls the air flow to manifold 14 during idle conditions of the engine. The use of cold start device 10 allows the cold start-up function to be removed from air by-pass valve 18.

As shown in the schematic of FIG. 2, control device 10 is provided with a low vacuum side that permits air flow from the atmosphere to the manifold during initial starting (low vacuum) and a high vacuum side which effectively closes device 10 during normal running speeds (high vacuum) of the internal combustion engine. Device 10 is provided with a passageway between the atmosphere and manifold 14 that is greater in cross-sectional area than the passageway in by-pass valve 18 so as to offer a less restricted air flow path than that offered by by-pass valve 18. Thus, device 10 effectively by-passes by-pass valve 18 when device 10 is in its open (low vac) position.

As seen in FIG. 3, control device 10 includes a casing 20 having a first port 22 that communicates with manifold 14 and a second port 24 that communicates with the atmosphere. First port 22 and second port 24 communicate with each other via passageway 26. As mentioned above, ports 22 and 24 and passageway 26 are dimensioned so as to provide a cross-sectional area greater than that in by-pass valve 18 so as to offer a less restricted air flow path than the by-pass valve.

Port 22 communicates with a pair of openings **28*a* and 28*b* located on opposite sides of casing 20. Opening 28*a* communicates with the manifold side of bypass valve 18 and opening 28*b* communicates with the manifold side of throttle valve 16**.

Second port 24 communicates with a pair of openings **30*a* and 30*b* disposed on opposite sides of casing 20 with opening 30*a* communicating with the atmosphere side of by-pass valve 18 and opening 30*b*** communicating with atmosphere.

Figure 6:
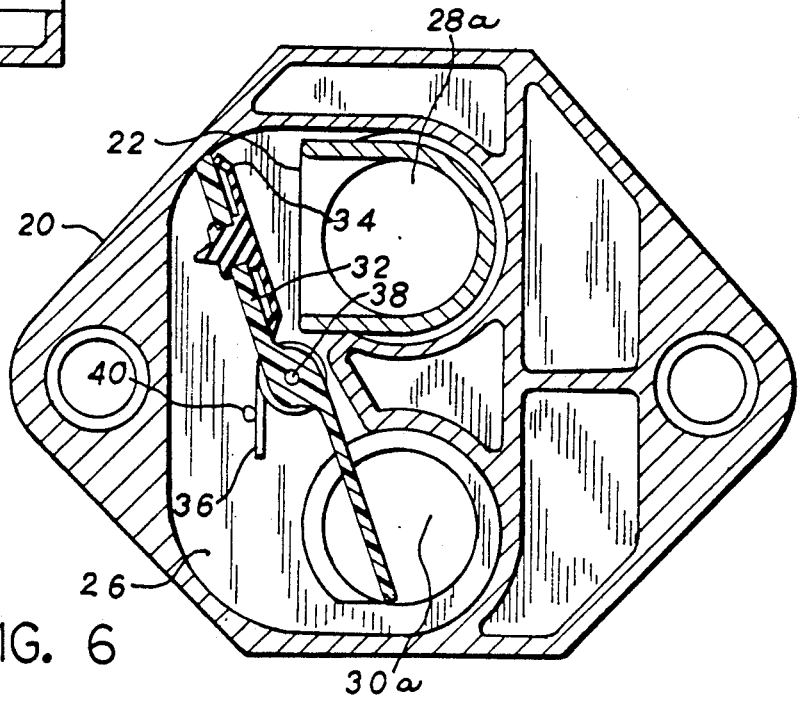
FIG. 6 is a top sectional view of the device in FIG. 3 with the valve in an open position.

A pivoting valve member 32 is disposed within casing 20 is provided with a valve seat 34 that effectively closes first port 22. Spring 36 is mounted on valve access 38 and cooperates with pin 40 to urge valve member 32 to its open position as shown in FIG. 6.

In use, control device 10 is mounted on throttle body 42 so that passageway 26 parallels those of the throttle valve and the by-pass valve. During cold starts, little or no negative air pressure is generated by manifold 14 and thus valve member 34 will remain in its biased open position so as to allow air flow from atmosphere through openings 30*a* and 30*b*, passageway 26 and opening 28*b* so that manifold 14 is provided with an increased air supply during cold starts. As the internal combustion engine reaches a normal operating speed, a vacuum or negative air pressure will be generated in manifold 14 and this negative air pressure will be communicated through opening 28*b* to first port 22. At a negative air pressure of approximately 5" Hg valve member 32 will move to its closed position (FIG. 3), thus eliminating the air flow through passageway 26. With valve member 32 in the closed position, the air supply to manifold 14 is controlled by by-pass valve 18 and throttle valve 16. Valve member 32 will not return to its open position until the manifold pressure drops to a value of approximately 2" Hg.

Thus, the present invention provides a cold start air control device that by-passes both throttle valve 16 and by-pass valve 18 to provide increased air flow during the initial start-up of an internal combustion engine.

Various modes of carrying out the invention are contemplated as being within the scope of the following claims particularly pointing out and distinctly claiming the subject matter which is regarded as the invention.

We claim:

1. A cold start air control device for an internal combustion engine having an air delivery system in which the delivery of air to a vacuum generating manifold is controlled by a throttle valve and a by-pass valve having a predetermined crosssectional area and disposed in parallel with the throttle valve, said control device comprising:

means defining a passageway in parallel with the throttle valve and the by-pass valve and having a cross-sectional area greater than the by-pass valve so as to offer a less restricted air flow path than the by-pass valve, said passageway providing communication between the manifold and atmosphere, valve means disposed within said passageway for opening and closing said passageway, said valve means biased to said open position and movable to said closed position in response to a predetermined vacuum level generated in the manifold.

2. The cold start air control device defined in claim 1 wherein said predetermined vacuum level is substantially 5" Hg.

3. The cold start air control device defined in claim 1 wherein said passageway defining means comprises:

a casing disposed on the throttle body and having a first port communicating with the manifold and a second port communicating with atmosphere, a passageway connecting said first and second ports and said valve means disposed within said passageway so as to open and close said first port.

4. The cold start air control device defined in claim 3 wherein said casing is disposed between the by-pass valve and the throttle valve and said first port includes a pair of openings in said casing with one of said openings communicating with the manifold side of the by-pass valve and the other of said openings communicating with the manifold side of the throttle valve.

5. The cold start air cont.rol device defined in claim 3 wherein said casing is disposed between the by-pass valve and the throttle valve and said second port includes a pair of openings in said casing with one of said openings communicating with the atmosphere side of the by-pass valve and the other of said openings communicating with the atmosphere.

6. The cold start air control device defined in claim 3 wherein said valve means is pivot:'ly Jisposed within said casing.

7. A cold start air control device for an internal combustion engine having an air delivery system in which the delivery of air to a vacuum generating manifold is controlled by a throttle valve and a by-pass valve having a predetermined cross-sectional area and disposed in parallel with the throttle valve, said control device comprising:

a casing disposed on the throttle body and having a first port communicating with the manifold and a second port communicating with atmosphere, a passageway connecting said first and second ports and valve means disposed within said passageway for opening and closing said passageway, said valve means biased to said open position and movable to said closed position in response to a predetermined vacuum level generated in the manifold.

8. The cold start air control device defined in claim 7 wherein said casing is disposed between the by-pass valve and the throttle valve and said first port includes a pair of openings in said casing with one of said openings communicating with the manifold side of the by-pass valve and the other of said openings communicating with the manifold side of the throttle valve.

9. The cold start air control device defined in claim 7 wherein said casing is disposed between the by-pass valve and the throttle valve and said second port includes a pair of openings in said casing with one of said openings communicating with the atmosphere side of the by-pass valve and the other of said openings communicating with the atmosphere.

10. The cold start air control device defined in claim 7 wherein said valve means is pivotally disposed within said casing.

* * * * *